United States Patent [19]

Diederich et al.

[11] 4,401,243

[45] Aug. 30, 1983

[54] CHARGING A MOLD FOR CONTINUOUS CASTING

[75] Inventors: Gerd Diederich, Düsseldorf; Rolf Solmecke, Meerbusch; Hans Hüsselmann, Krefeld; Eberhard Heimann, Bad Hönningen; Frithjof Schäuffele, Leutesdorf, all of Fed. Rep. of Germany

[73] Assignee: Mannesmann Aktiengesellschaft, Düsseldorf, Fed. Rep. of Germany

[21] Appl. No.: 841,384

[22] Filed: Oct. 12, 1977

[30] Foreign Application Priority Data

Oct. 13, 1976 [DE] Fed. Rep. of Germany ..... 2646707

[51] Int. Cl.[3] ..... B22D 11/10

[52] U.S. Cl. ..... 222/591; 164/437

[58] Field of Search ..... 164/82, 134, 135, 182, 164/437, 337; 222/591, 606, 566, 567, 607, 595; 428/284; 266/209, 210, 275, 280, 287; 106/57 (U.S. only), 50, 65

[56] References Cited

U.S. PATENT DOCUMENTS

| | | | |
|---|---|---|---|
| 3,279,003 | 10/1966 | Yates | 222/566 UX |
| 3,529,753 | 9/1970 | Mack | 222/595 X |
| 3,800,853 | 4/1974 | Neumann et al. | 164/437 |
| 3,996,145 | 12/1976 | Hepburn | 106/57 X |

FOREIGN PATENT DOCUMENTS

| | | | |
|---|---|---|---|
| 2500478 | 7/1976 | Fed. Rep. of Germany | 164/437 |
| 49-48047 | 12/1970 | Japan | 164/437 |
| 871577 | 6/1961 | United Kingdom | 106/50 |

OTHER PUBLICATIONS

"Kaowool ® Ceramic Fiber Products", Babcock and Wilcox: Dec. 1, 1970.

*Primary Examiner*—David A. Scherbel
*Attorney, Agent, or Firm*—Ralf H. Siegemund

[57] ABSTRACT

A pipe like feeder nozzle for injecting molten steel into a mold for continuous casting is constructed from a refractory material and has its lower part covered with a porous e.g. fibrous, refractory cover bonded to the feeder pipe by a refractory bonding agent.

3 Claims, 2 Drawing Figures

Fig. 2 (A-B)

CHARGING A MOLD FOR CONTINUOUS CASTING

BACKGROUND OF THE INVENTION

The present invention relates to a refractory submerged feeder nozzle for discharging and injecting steel into a mold for continuous casting.

It is customary to feed steel from a tundish, ladle or the like into a casting mold by means of a pipe like feeder nozzle. This pipe runs the molten metal through the surface of the steel bath in the mold and here particularly through the layer of casting powder and slag covering that surface, deeper into the bath itself. The known feeder pipes consist of refractory material such as pure, amorphous silica or graphite treated material that contains alumina. In other cases, one has used zirconium-silicate and other highly fire proof materials. U.S. Pat. No. 3,517,726 is representative of this state of the art.

It has been found that such feeder nozzles produce certain deposits in the mold right in the beginning of casting. The cause for this formation is to be seen in the high temperature differential between the molten steel and the pipe having a very high thermal conductivity. The use of glazed feeder pipes reduces but does not eliminate the formation of such deposits.

Another problem is the erosion of the feeder pipe particularly in the zone of contact with the rather aggresive powder slag. The wear resulting therefrom is more extensive than the wear of the pipe on account of the molten steel. The particular erosion weakens the feeder locally, causing it to break sooner or later. It has been suggested to skirt the feeder in the slag range by means of a fire proof annulus, which is an exchangeable piece and has but a small distance from the feeder; see for example German printed patent application No. 20 42 897. Impeding the slag aggression has also been tried by chosing an elliptical, outer cross-sectional contour of the pipe (see German printed patent application No. 23 58 339) and the casting flow is internally guided along the major axis of the ellipse.

DESCRIPTION OF THE INVENTION

It is an object of the present invention to provide a new and improved feeder nozzle for charging a mold with steel for continuous casting, which feeder nozzle resists aggression by casting powder slag and which avoids the formation of deposits in the mold.

In accordance with the preferred embodiment of the invention it is suggested to line the outside of an otherwise conventional refractory feeder nozzle or feeder pipe with a porous, preferably fibrous layer of one or several refractory oxides, using a refractory bonding agent. The thus covered pipe is dried and/or fired and is then ready for use. The cover must extend over at least that portion of the pipe which (but for the cover) would be in contact (from the outside) with the steel in the mold or with casting powder slag. The invention is not disclosed nor suggested by the prior art as referred to above.

DESCRIPTION OF THE DRAWING

While the specification concludes with claims particularly pointing out and distictly claiming the subject matter which is regarded as the invention, it is believed that the invention, the objects and features of the invention and further objects, features and advantages thereof will be better understood from the following description taken in connection with the accompanying drawings in which:

FIG. 2 is a section view along line A–B in FIG. 1.

Figure 1:
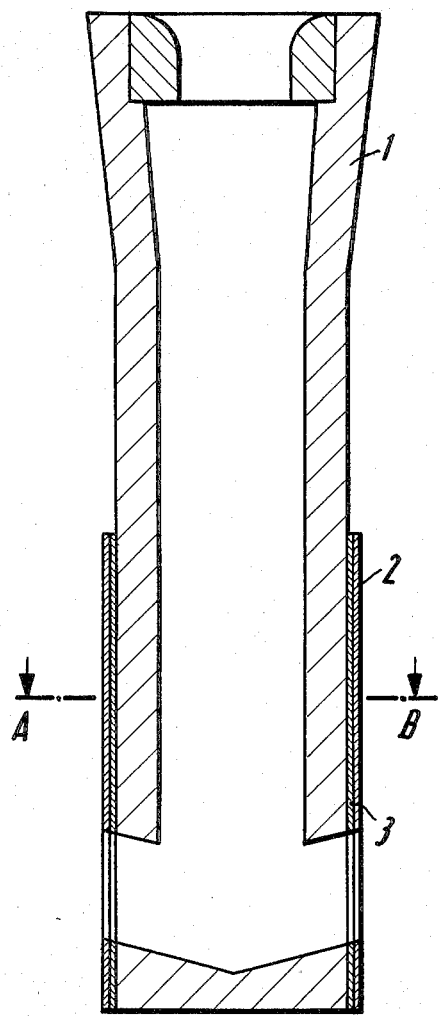
FIG. 1 is a longitudinal section view of a feeder nozzle and pipe for molten steel in accordance with the preferred embodiment of the invention.
Figure 1:
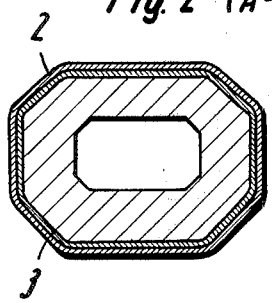

Proceeding now to the detailed description of the drawings, the figures show a pipe like feeder nozzle 1 made conventionally of fire proof refractory material. The feeder is configured as can be directly taken from the drawings, though other configurations are conceivable. The feeder pipe and nozzle has essentially a downwardly extending duct of rectangular inner and outer cross-sections with cut off corners. The bottom of the pipe is closed and the exit is established by two oppositely extending ducts having a slight upward slant. For the construction of the duct as such, see for example U.S. Pat. No. 3,996,994.

Now, in accordance with the invention, the lower part of the feeder nozzle is covered with a heat insulating, porous layer 2. This layer 2 is provided to cover the feeder pipe at least in the zone of contact with casting powder and slag on the surface of the mold for continuous casting, and, of course, layer 2 covers all of the portion of pipe 1 that could otherwise be in contact with the molten steel bath.

The layer 2 is comprised of one or several refractory oxides such as alumina, silica, zirconium oxide and/or chromium oxide in a porous state. The layer 2 is preferably constructed from these materials in a fibrous consistency and which have been made into a mat, a fleece or the like. The fibers have been made by blowing a molten mixture of such oxides to obtain fibers, followed by pressing the loose fibers into a porous mat, fleece etc., which will not change its properties at the high temperatures that occur during casting.

The layer or cover 2 is affixed to the feeder pipe 1 by means of a refractory bonding material which is likewise resistive against slag aggression. The bonding agent is preferably a mixture of one or more of the following materials, stabilized zironcium oxide; zirconium silicate; or alumina (being the basic substance) and to be mixed with a binder such as waterglass, silicate or phosphates, possibly together with methyl cellulose.

The following bonding mixtures have been used successfully: 100 parts by weight zirconium oxide (Ca-stabilized) or 100 parts by weight zirconium silicate. To either of these was added 10 parts by weight, 5% type methyl cellulose solution and 12 parts by weight 45% silicate solution. It should be observed that mixtures of stabilized zirconium oxide and zirconium silicate can be used as base substance for the bonding agent 3. In some cases the adding of some $\alpha$ alumina may be desirable.

The fibrous cover 2 is bonded to pipe 1 by such a bonding agent and dried and/or fired. The feeder nozzle is subsequently ready to be used.

The invention is not limited to the embodiments of described above but all changes and modifications thereof not constituting departures from the spirit and scope of the invention are intended to be included.

We claim:

1. An immersion-type feeder pipe for charging a mold with steel for continuous casting, which pipe is made of a fireproof material, the improvement comprising an outer porous cover disposed over at least part of the pipe and made of a heat-insulating, fibrous fleece- or mat-like construction, the fibers being made of at least one refractory oxide selected from the group, comprising alumina, silica, zirconium oxide, and chromium oxide; and said cover being bonded to the pipe by means of a refractory bonding agent.

2. Feeder pipe as in claim 1, said bonding agent being selected from the group comprising stabilized zirconium oxide, zirconium solicate, and silica with a binder selected from the group waterglass, silicate and phosphate.

3. Feeder pipe as in claim 2, the bonding agent including additionally methyl cellulose.

* * * * *